US006679954B1

(12) United States Patent
Takano et al.

(10) Patent No.: US 6,679,954 B1
(45) Date of Patent: Jan. 20, 2004

(54) HIGH-STRENGTH, HIGH-TOUGHNESS STAINLESS STEEL EXCELLENT IN RESISTANCE TO DELAYED FRACTURE

(75) Inventors: Koji Takano, Hikari (JP); Takayoshi Matsui, Tokyo (JP); Koichi Yoshimura, Hikari (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/913,920

(22) PCT Filed: Dec. 16, 1999

(86) PCT No.: PCT/JP99/07084

§ 371 (c)(1),
(2), (4) Date: Aug. 17, 2001

(87) PCT Pub. No.: WO00/49190

PCT Pub. Date: Aug. 24, 2000

(30) Foreign Application Priority Data

Feb. 18, 1999 (JP) ..... 11-039529

(51) Int. Cl.[7] ..... C22C 38/44
(52) U.S. Cl. ..... 148/325
(58) Field of Search ..... 148/320, 325

(56) References Cited

U.S. PATENT DOCUMENTS

| | | | | |
|---|---|---|---|---|
| 4,154,629 A | | 5/1979 | Asai et al. | |
| 4,878,955 A | * | 11/1989 | Hoshino et al. | 148/325 |
| 5,171,384 A | * | 12/1992 | Igawa et al. | 148/325 |
| 5,503,687 A | * | 4/1996 | Berns | 148/230 |
| 5,503,797 A | | 4/1996 | Zoch et al. | |
| 5,851,313 A | | 12/1998 | Milam | |

FOREIGN PATENT DOCUMENTS

| | | | | |
|---|---|---|---|---|
| DE | 40 33 706 | | 2/1991 | |
| DE | 196 26 833 | | 1/1998 | |
| EP | 0 481 377 | | 4/1992 | |
| JP | 57-70265 | | 1/1989 | |
| JP | 4-180544 | | 6/1992 | |
| JP | 6-264194 | | 9/1994 | |
| JP | 7-316740 | | 12/1995 | |
| JP | H7-316740 | | 12/1995 | |
| JP | 8-311554 | | 11/1996 | |
| JP | 9-206792 | | 8/1997 | |
| JP | 11279706 A | * | 10/1999 | ..... C22C/38/00 |

* cited by examiner

*Primary Examiner*—Deborah Yee
(74) *Attorney, Agent, or Firm*—Kenyon & Kenyon

(57) ABSTRACT

The present invention makes the best use of a low-cost chemical composition in providing a high strength and high corrosion resistance stainless steel, which has improved delayed fracture resistance and toughness in particular, for building and construction uses, and as, for example, a stainless steel tapping screw. The present invention is, specifically, a stainless steel and a stainless steel screw with high strength and high toughness and excellent in delayed fracture resistance, characterized by: comprising, by mass, 0.01 to 0.25% of C, 0.05 to 1.0% of Si, 0.1 to 2.0% of Mn, 0.1 to 3.0% of Ni, 11.0 to 16.0% of Cr, 0.01 to 0.15% of N, and 0.01 to 3.0% of Mo; containing, optionally, 0.001 to 0.005% of B and/or one or more of 0.05 to 0.5% of Ti, 0.05 to 0.5% of Nb, and 0.05 to 0.5% of W; having less than 10% of ferrite in the center portion of the material; and having a mixed structure of martensite and 3 to 30% of austenite in the surface layer from the outermost surface to the depth of at least 1 μm, and a method to produce the same.

5 Claims, 1 Drawing Sheet

HIGH-STRENGTH, HIGH-TOUGHNESS STAINLESS STEEL EXCELLENT IN RESISTANCE TO DELAYED FRACTURE

TECHNICAL FIELD

The present invention relates to a high strength and high corrosion resistance stainless steel, which has, in particular, improved delayed fracture resistance and toughness, for building and construction uses, and to a stainless steel screw, for example.

BACKGROUND ART

Conventional high strength and high corrosion resistance stainless steel screws made of martensitic stainless steel have high strength and low toughness in the center portion and are prone to generate screw head fracture caused by delayed fracture and the like.

The addition of Ni has been proposed as a measure to improve the toughness and the delayed fracture resistance of martensitic stainless steels (see Japanese Unexamined Patent Publication No. H9-206792).

On the other hand, a dual phase steel the outermost layer of which consists of martensite and the center portion of which consists of martensite and ferrite is known to be good both in ductility and strength (see Japanese Unexamined Patent Publication No. H7-316740).

The above technologies can improve the toughness and delayed fracture property of conventional stainless steels, but sufficient effects cannot always be obtained when they are applied to screws for high fastening strength use.

DISCLOSURE OF THE INVENTION

In view of the above situation, the object of the present invention is to solve the problems and provide, at low cost, a stainless steel having improved toughness and delayed fracture resistance, in addition to corrosion resistance and strength.

The inventors of the present invention discovered, as a result of various studies to solve the above problems, that it was possible to stably produce a high strength and high toughness stainless steel excellent in delayed fracture resistance by controlling the metallographic structure (martensite+austenite) at the surface of a dual phase stainless steel material through the control of its chemical composition and of surface reforming such as nitriding.

They also discovered that it was possible to stably produce a high strength and high toughness stainless steel excellent in delayed fracture resistance by accelerating the surface nitriding through structure control to make it easier to harden the surface and by lowering the hardness of the center portion. The present invention has been established based on these findings.

The first present invention is, therefore, a high strength and high toughness stainless steel-excellent in delayed fracture resistance comprising 11.0 to 16.0 mass % of Cr and characterized by having a mixed structure consisting of martensite and 3 to 30% of austenite in the surface layer from the outermost surface to the depth of at least 1 $\mu$m.

The second present invention is a high strength and high toughness stainless steel excellent in delayed fracture resistance according to the first present invention, characterized in that said stainless steel comprises, by mass %, 0.06 to 0.25% of C, 0.05 to 1.0% of Si, 0.1 to 2.0% of Mn, 0.1 to 3.0% of Ni, 11.0 to 16.0% of Cr, 0.01 to 0.15% of N, and 0.01 to 3.0% of Mo, with the balance consisting of Fe and unavoidable impurities, and has less than 10% of ferrite structure in the center portion of the material.

The third present invention is a high strength and high toughness stainless steel excellent in delayed fracture resistance according to the first present invention, characterized in that said stainless steel comprises, by mass %, 0.01% or more but less than 0.06% of C, 0.05 to 1.0% of Si, 0.1 to 2.0% of Mn, 0.1 to 3.0% of Ni, 11.0 to 16.0% of Cr, 0.01 to 0.15% of N, and 0.01 to 3.0% of Mo, with the balance consisting of Fe and unavoidable impurities, and has 10 to 80% of ferrite structure in the center portion of the material.

The fourth present invention is a high strength and high toughness stainless steel excellent in delayed fracture resistance, as described above, characterized by containing 0.001 to 0.005 mass % of B.

The fifth present invention is a high strength and high toughness stainless steel excellent in delayed fracture resistance, as described above, characterized by containing, by mass %, 0.5% or less in total of one or more of 0.05 to 0.5% of Ti, 0.05 to 0.5% of Nb, and 0.05 to 0.5% of W.

The sixth present invention is a high strength and high toughness stainless steel excellent in delayed fracture resistance, as described above, characterized by containing 0.4 to 2.0 mass % of Cu.

Further, the seventh present invention is a method to produce a high strength and high toughness stainless steel excellent in delayed fracture resistance, characterized by nitriding a steel having the chemical composition described above in the temperature range equal to or higher than 950° C. so as to form a mixed structure consisting of martensite and 3 to 30% of austenite in the surface layer from the outermost surface to the depth of at least 1 $\mu$m.

The eighth present invention is a high strength and high toughness stainless steel screw excellent in delayed fracture resistance, characterized by: consisting of a steel having the chemical composition described above; having a mixed structure consisting of martensite and 3 to 30% of austenite in the surface layer from its outermost surface to the depth of at least 1 $\mu$m; and having a surface hardness equal to or higher than Hv 450.

The ninth present invention is a method to produce a high strength and high toughness stainless steel screw excellent in delayed fracture resistance, characterized by nitriding a screw having the chemical composition described above in the temperature range equal to or higher than 950° C. so as to form a mixed structure consisting of martensite and 3 to 30% of austenite in the surface layer from the outermost surface to the depth of at least 1 $\mu$m.

BEST MODE FOR CARRYING OUT THE INVENTION

In the first place, the chemical composition range of a steel having the matrix according to the first and second present inventions is explained hereafter.

0.06% or more of C is added to a steel to secure the strength of martensite in the matrix. If C is added in excess of 0.25%, however, steel toughness is deteriorated and so is delayed fracture resistance. For this reason, the upper limit of the content of C is set at 0.25%. A preferable C content range is from 0.010 to 0.20%.

0.05% or more of Si is added to a steel because Si is required for the deoxidation of steel. When it is added in excess of 1.0%, however, the steel hardness after softening heat treatment is increased as a result of solid solution hardening, and cold workability is deteriorated. The upper limit of the Si content is, therefore, set at 1.0%. A preferable range of the Si content is from 0.1 to 0.6%.

Mn is added to 0.1% or more because Mn is required for deoxidizing steel and accelerating the nitriding process in order to form a mixed structure consisting of martensite and austenite in the surface layer, through the nitriding treatment, within a short time. However, if Mn is added in excess of 2.0%, the above effect does not increase and softening resistance is increased, deteriorating cold workability as a consequence. For this reason, the upper limit of the Mn content is set at 2.0%. A preferable range of the Mn content is from 0.2 to 1.0%.

0.1% or more of Ni is added for the purpose of enhancing toughness and delayed fracture resistance. When more than 3.0% of Ni is added, however, softening resistance increases, deteriorating the cold workability as a result. For this reason, the upper limit of the Ni content is set at 3.0%. A preferable range of the Ni content is from 0.2 to 2.0%.

11.0% or more of Cr is added to form stainless steel and to accelerate the nitriding process for the purpose of forming a mixed structure consisting of martensite and austenite in the surface layer. When Cr is added in excess of 16%, however, the mixed structure consisting of martensite and austenite is not formed in the surface layer. For this reason, the upper limit of the Cr content is set at 16.0%. A preferable Cr content is from 12 to 15%.

0.01% or more of N is added to enhance the strength of martensite in the matrix. However, when N is added in excess of 0.15%, blowholes occur and the production becomes very difficult. For this reason, the upper limit of the N content is set at 0.15%. A preferable N content is from 0.01 to 0.12%.

0.01% or more of Mo is added to improve corrosion resistance of a steel. When it is added in excess of 3.0%, however, it becomes impossible to form a mixed structure consisting of martensite and austenite in the surface layer. For this reason, the upper limit of the Mo content is set at 3.0%. A preferable range of the Mo content is from 0.5 to 2.5%.

Figure 1:
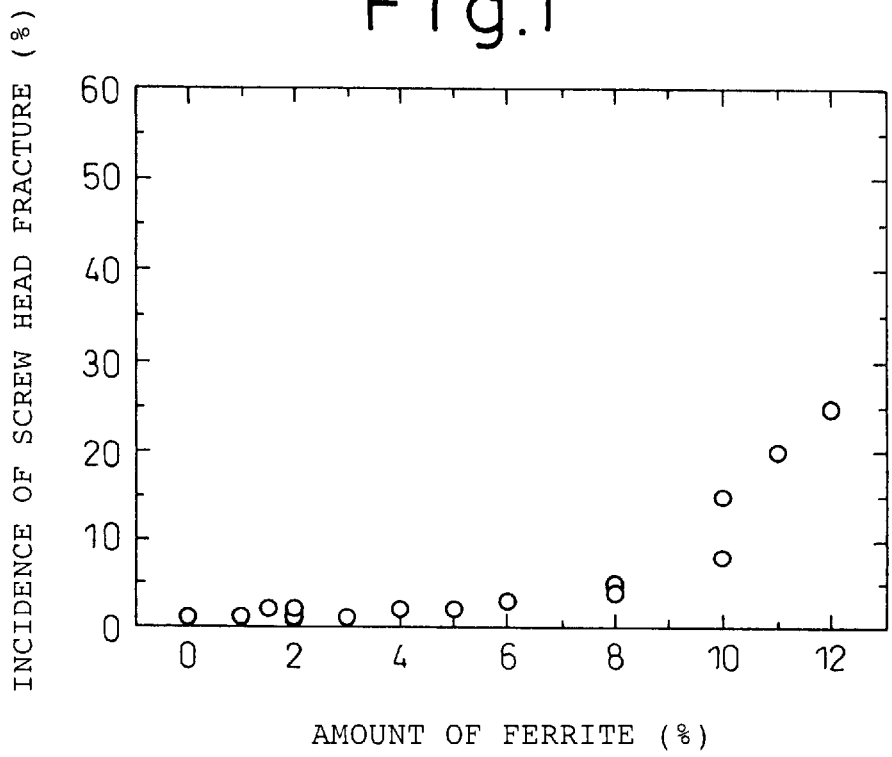
FIG. 1 is a graph showing the relationship between the amount of ferrite in the center portion of a steel material for screws and the incidence of screw head fracture (caused by impact during screw down and delayed fracture thereafter).

Explained below are the reasons why the amount of ferrite in the center portion of a material is limited in the present invention. When the amount of ferrite in the center portion is equal to or larger than 10%, carbo-nitrides of Cr precipitate at ferrite grain boundaries, deteriorating toughness. FIG. 1 shows the relationship between the amount of ferrite in the center portion of a steel material for screws of a 0.16C-0.2Si-0.3Mn-1.1Ni-13-to-16Cr-2Mo-0.09N system and the incidence of screw head fracture (caused by the impact during screw down and delayed fracture thereafter). When the ferrite amount is equal to or larger than 10%, the incidence of screw head fracture increases drastically. For this reason, the amount of ferrite in the center portion of a material is defined as below 10% and preferably 5% or less. Here, the balance of the center portion consists of a martensite phase or a martensite+austenite phase.

Next, explained are the reasons why the structure of the surface layer is limited in the present invention.

Figure 2:
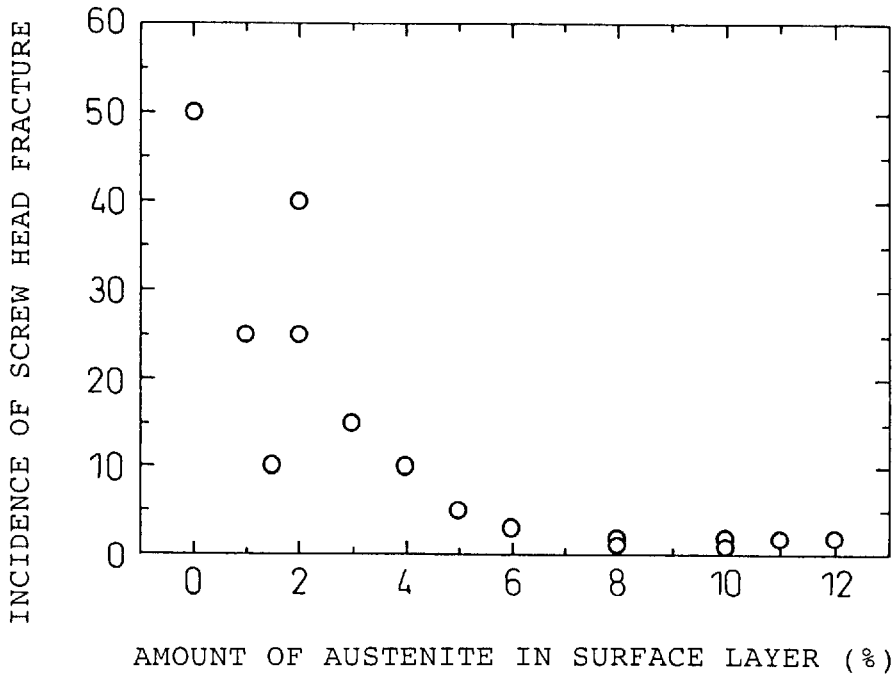
FIG. 2 is a graph showing the relationship between the amount of austenite in the surface layer and the incidence of screw head fracture (caused by the impact during screw down and delayed fracture thereafter).

When the structure in the layer from the outermost surface to the depth of at least 1 $\mu$m or more is composed of a martensite single phase, toughness and delayed fracture resistance are deteriorated. In order to improve the toughness and delayed fracture resistance, therefore, the present invention sets forth that the above layer has to comprise 3% or more of austenite in addition to the martensite. FIG. 2 shows the relationship between the amount of austenite in the surface layer and the incidence of screw head fracture (caused by the impact during screw down and delayed fracture thereafter). The figure demonstrates that, when the amount of austenite in the surface layer is equal to or lower than 3%, the incidence of screw head fracture increases drastically. When the layer contains more than 30% of austenite, on the other hand, the hardness of the surface is reduced and so is its strength. For this reason, the percentage of the austenite phase in the surface layer is limited to 30% or less. A preferable percentage range of the austenite is from 5 to 20%. Although the surface layers of the examples of the present invention are reformed by nitriding, other methods of surface reforming treatment such as carburizing, surface plating (+alloying treatment), etc. may also be employed in the present invention. The surface conditions stipulated in the present invention also include those obtained through a vacuum hardening process without the surface reforming.

Hereafter, the reasons for specifying the characteristics of the first, second and third present inventions are explained.

When there is 10% or more of ferrite in the center portion of a material and C is added in excess of 0.06%, carbonitrides of Cr precipitate at ferrite grain boundaries, deteriorating the toughness and the delayed fracture resistance of the steel. The upper limit of the C content is, therefore, set at below 0.06%. When the C content is less than 0.01%, in contrast, with the same ferrite percentage in the center portion, steel strength becomes insufficient and, hence, the lower limit of the C content is set at 0.01%.

Next, the reasons why the ferrite structure of the center portion of a material is limited in the present invention are explained.

If the structure of the center portion of a material is a mixed structure consisting of martensite and 10 to 80% of ferrite, its crystal grain size becomes as fine as 30 $\mu$m or less during nitriding at 950 to 1,100° C., and the nitriding process is accelerated by grain boundary diffusion, making it possible to effectively increase the surface strength while maintaining the strength at the center portion of the material at a low level and to form the dual phase structure of martensite and austenite in the layer from the outermost surface to the depth of at least 1 $\mu$m, so as to enhance toughness and delayed fracture resistance. For this reason, the structure of the center portion of a material is specified to include 10 to 80% of ferrite,.according to requirements. A, preferable percentage range of the ferrite is from 20 to 60%. Here, the balance of the center portion of the material consists of a martensite phase or a martensite+austenite phase.

Next, the reasons why the characteristics of the fourth present invention are specified are explained hereafter.

0.001% or more of B is added, as required, in order to further enhance the steel toughness. When it is added in excess of 0.005%, however, borides are formed and, adversely, the toughness is deteriorated. The upper limit of the B content is, therefore, set at 0.005%. A preferable range of B content is from 0.0015 to 0.004%.

Next, the reasons why the characteristics of the fifth present invention is specified are explained hereafter.

One or more of Ti, Nb and W is added to 0.05% or more each, as required, in order to suppress the crystal grain growth during quenching through the pinning effect of carbo-nitrides and to enhance steel toughness. When the elements are added in excess of 1.0% in total, in contrast, the toughness is deteriorated. For this reason, the upper limit of the total amount of these elements is set at 1.0%.

Then, the reasons why the characteristics of the sixth present invention is specified are explained hereafter. 0.4% or more of Cu is added, as required, for the purpose of increasing the corrosion resistance of a steel. When it is added in excess of 2.0%, however, the amount of retained austenite in the surface layer increases, resulting in a poor screw-driving property. For this reason, the upper limit of the Cu content is set at 2.0%.

Then, the reasons why the characteristics of the seventh present invention is specified are explained hereafter. When nitriding is applied at a temperature lower than 950° C., while the surface hardness increases, carbo-nitrides precipitate abundantly near the surface and steel toughness (screw head fracture resistance) is deteriorated. Hence, the lower limit of the nitriding temperature is set at 950° C.

Then, the reasons why the characteristics of the eighth present invention is specified are explained hereafter. A stainless steel screw applied to a hard material such as a steel sheet is not useful unless its surface hardness is at least Hv 450 or higher. For this reason, the lower limit of the surface hardness of a screw according to the present invention is set at Hv 450.

Example

The present invention is explained hereafter based on examples.

Table 1 shows the chemical compositions of steels A to I, T to W, AB, AC and AF to AH to which the present invention is applied (invented steels) and comparative steels J to S, W to Z, AA, AD, AE, and AI to AK.

The invented steels A to D and the comparative steels J to O have the chemical compositions of 0.2Si-13Cr-2Mo as their basic compositions and have varying contents (%) of C, Mn, Ni and N, which influence the structures of the surface layers and the toughness and delayed fracture resistance of the steels, with regard to the examples of the first, second and seventh to ninth present inventions.

The invented steels E and F and the comparative steel P have the chemical compositions of 0.16C-0.3Mn-1.1Ni-13Cr-2Mo-0.09N as their basic compositions and have varying contents (%) of Si, which influences the toughness and cold workability, with regard to the examples of the first, second and seventh to ninth present inventions.

The invented steels G to I and the comparative steels Q to S have the chemical compositions of 0.16C-0.2Si-1.2Ni-0.08N as their basic compositions and have varying contents (%) of Cr and Mo, which influence the structure of the surface layer and the toughness and delayed fracture resistance of the steels, with regard to the examples of the first, second and seventh to ninth present inventions.

The invented steels T to W and the comparative ;steels X to Z and AA have the chemical compositions of 0.2Si-0.4Mn-13Cr-2Mo as their basic compositions and have varying contents (%) of C, Ni and N, which influence the structure, strength, toughness and delayed fracture resistance, with regard to the examples of the first, third and seventh to ninth present inventions.

The invented steels B and AB and the comparative steel AD have the chemical compositions of 0.16C-0.3Si-0.3Mn-1.0Ni-13.1Cr-2.1Mo-0.08N as their basic compositions and have varying contents (%) of B, which influences toughness, with regard to the examples of the fourth and seventh to ninth present inventions.

The invented steels U and AC and the comparative steel AB have the chemical compositions of 0.02C-0.2Si-0.3Mn-1.1Ni-13Cr-2.1Mo-0.08N as their basic compositions and have varying contents (%) of B, which influences the toughness, with regard to the examples of the fourth and seventh to ninth present inventions.

The invented steels AF to AH and the comparative steels AI to AK have the chemical compositions of 0.02C/0.16C-0.2Si-0.3Mn-1.1Ni-13Cr-2Mo-0.07N as their basic compositions and have varying contents of Ti, Nb and W, which influence the grain size of retained austenite (toughness), with regard to the examples of the fifth and seventh to ninth present inventions.

The invented steels AL and AM and the comparative steels AN and AO have the chemical compositions of 0.02C/0.16C-0.2Si-0.3Mn-1.1Ni-13Cr-2Mo-0.07N as their basic compositions and have varying contents (%) of Cu, which influences the corrosion resistance and the screw-driving property, with regard to the examples of the sixth to ninth present inventions.

The above steels were hot-rolled into wire rods 5.5 mm in diameter at a finish rolling temperature of 1,000° C. through commonly-used stainless steel wire rod production processes. The hot-rolled products thus produced were softened in a batch annealing furnace, pickled, then cold-drawn into a diameter of 3.9 mm, softened in a batch annealing furnace and pickled once again, cold-drawn into a diameter of 3.85 mm, and cold-formed into drilling tapping screws with a cutting edge tip. Then, after removing the furnace atmosphere and replacing it with a nitrogen-atmosphere of 1 atm., the screws were nitrided therein at 1,030° C. for 100 min., quenched by nitrogen cooling, and then tempered at 200° C. The screw-driving property (an indicator of strength), toughness, delayed fracture property, the amount of ferrite in the center portion, and the amount of austenite at the outermost surface of the screws were measured.

Screw-driving tests were conducted, wherein 10 screws were driven into a steel sheet of SS400 (under Japanese Industrial Standard (JIS)) 1.6 mm in thickness under the load of 18 kg at the rotation speed of 2,500 rpm, and the screw-driving property was evaluated in terms of the time until the first thread of each screw was screwed into the steel sheet. The screw-driving property (strength) was evaluated as good (marked with ○),if said time was 3.5 sec. or shorter in average; poor (marked with X) if the average time exceeded 3.5 sec. All the examples of the present invention were evaluated as good in respect to the screw driving property (strength).

5 screws were completely driven into an SS400 steel plate 5 mm in thickness under the load of 27 kg at the rotation speed of 2,500 rpm without reducing the rotation speed, and the toughness of the screws was evaluated in terms of the incidence of screw head fracture after impact was applied. The toughness was evaluated as good (marked with ○) if none of the screw heads fractured; poor (marked with X) if any of the 5 screws showed screw head fracture. All the examples of the present invention were evaluated as good in respect to the toughness (screw head fracture resistance).

5 screws, each with a stainless steel washer, were completely driven into an SS400 steel plate 5 mm in thickness, driven further under a torque of 200 kg-cm, and then subjected to a salt spray test (5% NaCl, 35° C., 48 hr.), and the delayed fracture resistance was evaluated in terms of the incidence of screw head fracture after the above test. The delayed fracture resistance was evaluated as good (marked with ○) if none of the screw heads fractured; poor (marked with X) if the head of any of the 5 screws fractured. All the examples of the present invention were evaluated as good in respect to the delayed fracture resistance (screw head fracture resistance).

The amount of ferrite in the center portion of a material was measured from its area percentage obtained through image analysis, after mirror-polishing a longitudinal section passing through the center portion of a screw and tinting the ferrite at the section surface by the Murakami etching method. The ferrite amount of the steels according to the first present invention was less than 10% and the same of the steels according to the second present invention was 10 to 80%. The amount of austenite at the outermost surface was calculated from the peak strength ratio of austenite to ferrite in an X-ray diffraction measurement. The amount of austenite at the outermost surface of the steels according to the present invention was 3 to 30%.

Table 2 shows the evaluation results of the steels to which the first, second and seventh to ninth present inventions were applied. All the steels according to the present invention had a ferrite amount below 10% in the center portion and an austenite amount of 3 to 30% in the surface layer and demonstrated an excellent screw-driving property (strength), toughness and delayed fracture resistance.

Table 2 shows the property evaluation results of the steels to which the first, second and seventh to ninth present inventions were applied. As described above, the ferrite amounts in the center portion of the invented steels Nos. 1 to 9 were below 10% and their austenite amounts at the outermost surface were 3 to 30%. The steels demonstrated an excellent screw-driving property, toughness (screw head fracture resistance) and delayed fracture resistance.

Table 3 shows the evaluation results of the comparative steels in relation to the first, second and seventh to ninth present inventions.

The C content of comparative steel No. 10 was too low and, hence, it was poor in its screw-driving property. The C content of the comparative steel No. 11 was too high and, as a consequence, it was poor in toughness (screw head fracture resistance) and delayed fracture resistance. The Mn content of the comparative steel No. 12 was too low and its nitriding was not accelerated and, thus, its austenite amount at the outermost surface was as low as less than 3%. As a result, it was poor in its screw-driving property, toughness (screw head fracture resistance) and delayed fracture resistance. The comparative steels Nos. 13 and 14 had too high amounts of either Mn or Ni, and austenite amounts of 30% or more at the outermost surfaces, and the steels were poor in screw-driving properties. The N content of the comparative steel No. 15 was too high and its behavior during production was very poor owing to the occurrence of blowholes during casting. For this reason, the steel could not be manufactured into screws. The Si content of the comparative steel No. 16 was too high and, as a result, it was poor in toughness (screw head fracture resistance) and delayed fracture resistance. The Cr content of the comparative steel No. 17 was too low and its austenite amount at the outermost surface was below 3%, and the steel was poor in toughness (screw head fracture resistance) and delayed fracture resistance. The comparative steels Nos. 18 and 19 had too high amounts of either Cr or Mo, and the ferrite amounts in their center portions exceeded 10%. These steels were poor in toughness (screw head fracture resistance) and delayed fracture resistance.

Next, the evaluation results of the properties of the first, third and seventh to ninth present inventions are explained.

Table 4 shows the property evaluation results of the steels to which the first, third and seventh to ninth present inventions were applied. As described before, the amounts of ferrite in the center portion of the invented steels Nos. 20 to 23 were 10 to 80% and their amounts of austenite at the outermost surface were 3 to 30%, and they demonstrated excellent screw-driving properties, toughness (screw head fracture resistance) and delayed fracture resistance.

Table 5 shows the evaluation results of the properties of the comparative steels in relation to the first, third and seventh to ninth present inventions.

The C content of the comparative steel No. 24 was too high and, thence, it was poor in toughness (screw head fracture resistance) and delayed fracture resistance. The C content of the comparative steel No. 25 was too low and, as a result, it was poor in its screw-driving property. The ferrite amount in the center portion of the comparative steel No. 26 exceeded 80%, and it was poor in screw driving property. The comparative steel No. 27 had a ferrite amount less than 10% in the center portion, and it was poor in screw-driving property.

Table 6 shows the evaluation results of the examples of the fourth and the seventh to ninth present inventions.

The invented examples Nos. 28 and 29 showed excellent screw-driving properties, toughness (screw head fracture resistance) and delayed fracture resistance. In contrast, the B contents of the comparative examples Nos. 30 and 31 exceeded 0.005%, and the examples showed poor toughness (screw head fracture resistance) and delayed fracture resistance.

Table 7 shows the evaluation results of the examples of the fifth and the seventh to ninth present inventions.

The invented examples Nos. 32 to 34 showed excellent screw-driving properties, toughness (screw head fracture resistance) and delayed fracture resistance. In contrast, the total contents of Ti, Nb and W of the comparative examples Nos. 35 to 37 exceeded 0.5%, and the examples had only poor toughness (screw head fracture resistance) and delayed fracture resistance.

Table 8 shows the evaluation results of the examples of the sixth to ninth present inventions.

The invented examples Nos. 38 and 39 showed excellent screw-driving properties, toughness (screw head fracture resistance) and delayed fracture resistance. In contrast, the contents of Cu of the comparative examples Nos. 40 and 41 exceeded 2.0%, and the examples showed poor screw-driving properties.

The superior performance of the steels according to the present invention is clear from the above examples.

TABLE 1

Chemical compositions of invented steels and comparative steels

| Steel | C | Si | Mn | P | S | Ni | Cr | Mo | Cu | Al | O | N | B | Ti | Nb | W |
|---|---|---|---|---|---|---|---|---|---|---|---|---|---|---|---|---|
| Invented steel | | | | | | | | | | | | | | | | |
| A | 0.19 | 0.2 | 0.3 | 0.014 | 0.004 | 0.3 | 13.1 | 2.1 | 0.1 | 0.01 | 0.005 | 0.03 | — | — | — | — |
| B | 0.17 | 0.3 | 0.3 | 0.025 | 0.004 | 1.1 | 13.1 | 2.1 | 0.1 | 0.01 | 0.005 | 0.08 | — | — | — | — |
| C | 0.11 | 0.2 | 0.6 | 0.023 | 0.005 | 1.8 | 12.8 | 2 | 0.2 | 0.02 | 0.004 | 0.09 | — | — | — | — |
| D | 0.07 | 0.15 | 1.6 | 0.021 | 0.002 | 2.6 | 13.1 | 1.8 | 0.2 | 0.009 | 0.003 | 0.12 | — | — | — | — |
| E | 0.16 | 0.08 | 0.3 | 0.018 | 0.003 | 1.1 | 13.1 | 2 | 0.2 | 0.009 | 0.006 | 0.09 | — | — | — | — |
| F | 0.17 | 0.8 | 0.4 | 0.02 | 0.002 | 1.3 | 12.8 | 1.9 | 0.3 | 0.012 | 0.004 | 0.09 | — | — | — | — |
| G | 0.16 | 0.4 | 0.3 | 0.02 | 0.002 | 1.3 | 11.5 | 2.7 | 0.2 | 0.005 | 0.005 | 0.08 | — | — | — | — |
| H | 0.16 | 0.3 | 0.3 | 0.026 | 0.003 | 1.3 | 14.2 | 1 | 0.2 | 0.006 | 0.005 | 0.09 | — | — | — | — |
| I | 0.15 | 0.2 | 0.3 | 0.026 | 0.003 | 1.3 | 15.8 | 0.1 | 0.2 | 0.023 | 0.004 | 0.08 | — | — | — | — |
| Comparative steel | | | | | | | | | | | | | | | | |
| J | 0.05* | 0.15 | 0.6 | 0.014 | 0.004 | 2.9 | 12.7 | 1.7 | 0.3 | 0.013 | 0.005 | 0.1 | — | — | — | — |
| K | 0.24* | 0.2 | 0.3 | 0.014 | 0.004 | 0.3 | 13.1 | 2.1 | 0.3 | 0.013 | 0.005 | 0.06 | — | — | — | — |
| L | 0.15 | 0.3 | 0.08* | 0.025 | 0.004 | 1 | 13.1 | 2.1 | 0.1 | 0.01 | 0.003 | 0.08 | — | — | — | — |
| M | 0.17 | 0.3 | 2.5* | 0.025 | 0.004 | 1.1 | 13.1 | 2.1 | 0.1 | 0.01 | 0.003 | 0.08 | — | — | — | — |
| N | 0.16 | 0.2 | 0.5 | 0.024 | 0.005 | 3.1* | 13.2 | 2 | 0.2 | 0.015 | 0.004 | 0.06 | — | — | — | — |
| O | 0.12 | 0.4 | 0.5 | 0.021 | 0.002 | 1.2 | 13.1 | 1.9 | 0.2 | 0.021 | 0.004 | 0.16* | — | — | — | — |
| P | 0.16 | 1.3* | 0.3 | 0.018 | 0.003 | 1.3 | 13.1 | 2 | 0.1 | 0.009 | 0.006 | 0.09 | — | — | — | — |
| Q | 0.16 | 0.3 | 0.3 | 0.021 | 0.002 | 1.3 | 10.5* | 2 | 0.2 | 0.004 | 0.005 | 0.08 | — | — | — | — |
| R | 0.16 | 0.2 | 0.3 | 0.019 | 0.002 | 1.2 | 16.8* | 1 | 0.1 | 0.015 | 0.005 | 0.09 | — | — | — | — |
| S | 0.15 | 0.2 | 0.3 | 0.025 | 0.003 | 1.3 | 13.1 | 3.3* | 0.2 | 0.023 | 0.004 | 0.08 | — | — | — | — |
| Invented steel | | | | | | | | | | | | | | | | |
| T | 0.01 | 0.25 | 0.3 | 0.027 | 0.002 | 0.6 | 13.2 | 2 | 0.2 | 0.015 | 0.004 | 0.07 | — | — | — | — |
| U | 0.02 | 0.2 | 0.4 | 0.027 | 0.002 | 1.1 | 13 | 2.1 | 0.2 | 0.015 | 0.005 | 0.08 | — | — | — | — |
| V | 0.03 | 0.18 | 0.5 | 0.025 | 0.004 | 1.1 | 13.1 | 2 | 0.2 | 0.009 | 0.003 | 0.08 | — | — | — | — |
| W | 0.05 | 0.32 | 0.4 | 0.023 | 0.002 | 1.4 | 13 | 2 | 0.2 | 0.016 | 0.004 | 0.08 | — | — | — | — |
| Comparative steel | | | | | | | | | | | | | | | | |
| X | 0.08* | 0.31 | 0.4 | 0.026 | 0.003 | 0.6 | 13.1 | 2 | 0.2 | 0.018 | 0.003 | 0.05 | — | — | — | — |
| Y | 0.005* | 0.2 | 0.4 | 0.027 | 0.002 | 1.1 | 13 | 2.1 | 0.2 | 0.015 | 0.005 | 0.08 | — | — | — | — |
| Z | 0.015 | 0.17 | 0.4 | 0.024 | 0.003 | 0.2 | 13.1 | 2 | 0.1 | 0.01 | 0.003 | 0.02 | — | — | — | — |
| AA | 0.055 | 0.17 | 0.5 | 0.024 | 0.003 | 2.8 | 13 | 1.9 | 0.1 | 0.01 | 0.003 | 0.08 | — | — | — | — |
| Invented steel | | | | | | | | | | | | | | | | |
| AB | 0.16 | 0.3 | 0.3 | 0.020 | 0.003 | 1.1 | 13.1 | 2.1 | 0.1 | 0.01 | 0.005 | 0.08 | 0.0030 | — | — | — |
| AC | 0.02 | 0.2 | 0.4 | 0.028 | 0.003 | 1.1 | 13 | 2.1 | 0.2 | 0.015 | 0.005 | 0.08 | 0.0020 | — | — | — |
| Comparative steel | | | | | | | | | | | | | | | | |
| AD | 0.16 | 0.2 | 0.3 | 0.018 | 0.004 | 1.1 | 13.1 | 2.1 | 0.2 | 0.02 | 0.005 | 0.08 | 0.0080* | — | — | — |
| AE | 0.02 | 0.2 | 0.3 | 0.022 | 0.0024 | 1.1 | 13 | 2.1 | 0.2 | 0.010 | 0.005 | 0.08 | 0.0070* | — | — | — |
| Invented steel | | | | | | | | | | | | | | | | |
| AF | 0.16 | 0.3 | 0.3 | 0.020 | 0.003 | 1.1 | 13.1 | 2.1 | 0.1 | 0.01 | 0.005 | 0.08 | — | 0.2 | — | 0.1 |
| AG | 0.16 | 0.3 | 0.3 | 0.022 | 0.002 | 1.1 | 13 | 2.1 | 0.1 | 0.012 | 0.005 | 0.07 | — | 0.1 | 0.2 | — |
| AH | 0.02 | 0.2 | 0.4 | 0.025 | 0.002 | 1 | 13.1 | 2 | 0.2 | 0.015 | 0.005 | 0.06 | — | — | — | 0.3 |
| Comparative steel | | | | | | | | | | | | | | | | |
| AI | 0.15 | 0.3 | 0.3 | 0.024 | 0.0025 | 1.1 | 13 | 2 | 0.1 | 0.01 | 0.005 | 0.08 | — | 0.3 | — | 0.3 |
| AJ | 0.16 | 0.2 | 0.3 | 0.019 | 0.0031 | 1 | 13 | 2.1 | 0.1 | 0.012 | 0.005 | 0.07 | — | — | 0.5 | 0.1 |
| AK | 0.02 | 0.2 | 0.4 | 0.028 | 0.0018 | 1 | 13 | 2 | 0.2 | 0.015 | 0.005 | 0.06 | — | — | — | 0.6 |
| Invented steel | | | | | | | | | | | | | | | | |
| AL | 0.16 | 0.2 | 0.4 | 0.025 | 0.0015 | 1.1 | 13 | 2 | 1.0 | 0.003 | 0.006 | 0.07 | | | | |
| AM | 0.02 | 0.3 | 0.4 | 0.026 | 0.0020 | 1.1 | 13 | 2 | 1.5 | 0.020 | 0.004 | 0.07 | | | | |
| Comparative steel | | | | | | | | | | | | | | | | |
| AN | 0.16 | 0.2 | 0.3 | 0.018 | 0.0031 | 1.0 | 13.1 | 1.9 | 2.3 | 0.010 | 0.003 | 0.06 | | | | |
| AO | 0.02 | 0.3 | 0.4 | 0.022 | 0.0018 | 1.1 | 12.9 | 2 | 2.2 | 0.010 | 0.003 | 0.07 | | | | |

TABLE 2

Evaluation results of properties of invented steels to which claims 1 and 6 to 8 are applied

| No | Steel | Ferrite amount in the center portion of material (%) | Austenite amount at outermost surface (%) | Screw-driving property | Toughness (screw head fracture resistance) | Delayed fracture resistance |
|---|---|---|---|---|---|---|
| 1 | A | 8 | 8 | ○ | ○ | ○ |
| 2 | B | 1 | 13 | ○ | ○ | ○ |
| 3 | C | 3 | 6 | ○ | ○ | ○ |
| 4 | D | 0 | 5 | ○ | ○ | ○ |
| 5 | E | 0 | 8 | ○ | ○ | ○ |
| 6 | F | 0 | 23 | ○ | ○ | ○ |
| 7 | G | 0 | 5 | ○ | ○ | ○ |
| 8 | H | 0 | 7 | ○ | ○ | ○ |
| 9 | I | 0 | 9 | ○ | ○ | ○ |

TABLE 3

Evaluation results of comparative steels related to claims 1 and 6 to 8

| No | Steel | Ferrite amount in the center portion of material (%) | Austenite amount at outermost surface (%) | Screw-driving property | Toughness (screw head fracture resistance) | Delayed fracture resistance |
|---|---|---|---|---|---|---|
| 10 | J | 8 | 4 | x | ○ | ○ |
| 11 | K | 0 | 9 | ○ | x | x |
| 12 | L | 2 | 2* | x | x | x |
| 13 | M | 0 | 31* | x | ○ | ○ |
| 14 | N | 0 | 33* | x | ○ | ○ |
| 15 | O | — | — | — | — | — |
| 16 | P | 2 | 17 | ○ | x | x |
| 17 | Q | 0 | 1* | ○ | x | x |
| 18 | R | 12* | 18 | ○ | x | x |
| 19 | S | 15* | 18 | ○ | x | x |

TABLE 4

Evaluation results of properties of invented steels to which claims 2 and 6 to 8 are applied

| No | Steel | Ferrite amount in the center portion of material (%) | Austenite amount at outermost surface (%) | Screw-driving property | Toughness (screw head fracture resistance) | Delayed fracture resistance |
|---|---|---|---|---|---|---|
| 20 | T | 70 | 8 | ○ | ○ | ○ |
| 21 | U | 50 | 10 | ○ | ○ | ○ |
| 22 | V | 40 | 6 | ○ | ○ | ○ |
| 23 | W | 28 | 22 | ○ | ○ | ○ |

TABLE 5

Evaluation results of properties of invented steels to which claims 2 and 6 to 8 are applied

| No | Steel | Ferrite amount in the center portion of material (%) | Austenite amount at outermost surface (%) | Screw-driving property | Toughness (screw head fracture resistance) | Delayed fracture resistance |
|---|---|---|---|---|---|---|
| 24 | X | 35 | 10 | ○ | x | x |
| 25 | Y | 65 | 8 | x | ○ | ○ |
| 26 | Z | 85* | 5 | x | ○ | ○ |
| 27 | AA | 8* | 18 | x | ○ | ○ |

TABLE 6

Evaluation results of properties of invented steels to which claims 3 and 6 to 8 are applied and comparative steels

| Classification | No | Steel | Ferrite amount in the center portion of material (%) | Austenite amount at outermost surface (%) | Screw-driving property | Toughness (screw head fracture resistance) | Delayed fracture resistance |
|---|---|---|---|---|---|---|---|
| Invention example | 28 | AB | 2 | 12 | ○ | ○ | ○ |
| Invention example | 29 | AC | 42 | 6 | ○ | ○ | ○ |
| Comparative example | 30 | AD | 3 | 14 | ○ | x | x |
| Comparative example | 31 | AE | 45 | 8 | ○ | x | x |

TABLE 7

Evaluation results of properties of invented steels to which claims 4 to 7 are applied and comparative steels

| Classification | No | Steel | Ferrite amount in the center portion of material (%) | Austenite amount at outermost surface (%) | Screw-driving property | Toughness (screw head fracture resistance) | Delayed fracture resistance |
|---|---|---|---|---|---|---|---|
| Invention example | 32 | AF | 3 | 12 | ○ | ○ | ○ |
| Invention example | 33 | AG | 4 | 10 | ○ | ○ | ○ |
| Invention example | 34 | AH | 50 | 10 | ○ | ○ | ○ |
| Comparative example | 35 | AI | 4 | 15 | ○ | x | x |
| Comparative example | 36 | AJ | 3 | 14 | ○ | x | x |
| Comparative example | 37 | AK | 46 | 12 | ○ | x | x |

TABLE 8

Evaluation results of properties of invented steels to which claims 5 to 8 are applied and comparative steels

| Classification | No | Steel | Ferrite amount in the center portion of material (%) | Austenite amount at outermost surface (%) | Screw-driving property | Toughness (screw head fracture resistance) | Delayed fracture resistance |
|---|---|---|---|---|---|---|---|
| Invention example | 38 | AL | 1 | 20 | ○ | ○ | ○ |
| Invention example | 39 | AM | 40 | 25 | ○ | ○ | ○ |
| Comparative example | 40 | AN | 0 | 32 | x | ○ | ○ |
| Comparative example | 41 | AO | 30 | 33 | x | ○ | ○ |

INDUSTRIAL APPLICABILITY

As is clear from the above examples, the present invention makes it possible to produce, stably and at low cost, a high strength and high corrosion resistance stainless steel for building and construction uses, for example as a stainless steel tapping screw, in which, especially, the delayed fracture resistance and toughness are improved, and hence the present invention is industrially very useful.

What is claimed is:

1. A stainless steel excellent in delayed fracture resistance characterized in that the stainless steel consists essentially of, by mass %, 0.06 to 0.25%. of C, 0.05 to 1.0% of Si, 0.1 to 2.0% of Mn, 0.1 to 3.0% of Ni, 11.0 to 16.0% of Cr, 0.01 to 0.15% of N, and 0.01 to 3.0% of Mo, with the balance Fe and unavoidable impurities;

said stainless steel having a surface layer consisting of a dual structure of martensite and 3 to 30% of austenite in the surface layer from an outermost surface to a depth of at least 1 $\mu$m and a center portion consisting of less than 10% of ferrite with the center portion balance consisting of a martensite phase free from austenite phase.

2. A stainless steel excellent in delayed fracture resistance characterized in that said stainless steel consists essentially of, by mass %, 0.01 or more but less than 0.06% of C, 0.05 to 1.0% of Si, 0.1 to 2.0% of Mn, 0.1 to 3.0% of Ni, 11.0 to 16.0% of Cr, 0.01 to 0.15% of N, and 0.01 to 3.0% of Mo, with the balance Fe and unavoidable impurities, said stainless steel having a surface layer consisting of a dual structure of martensite and 3 to 30% of austenite in the surface layer from an outermost surface to a depth of at least 1 $\mu$m and a center portion consisting of 10 to 80% of ferrite with the center portion balance consisting of a martensite phase free from austenite phase.

3. A stainless steel excellent in delayed fracture resistance according to claim 1 or 2, characterized by further containing 0.001 to 0.005 mass % of B.

4. A stainless steel excellent in delayed fracture resistance according to claim 1 or 2, characterized by further containing, by mass %, 0.5% or less in total of one or more of 0.05 to 0.5% of Ti, 0.05 to 0.5% of Nb, and 0.05 to 0.5% of W.

5. A stainless steel excellent in delayed fracture resistance according to claim 1 or 2, characterized by further containing 0.4 to 2.0 mass % of Cu.

* * * * *